US006985063B2

(12) United States Patent
Chen et al.

(10) Patent No.: US 6,985,063 B2
(45) Date of Patent: Jan. 10, 2006

(54) TRANSFORMER CORE

(75) Inventors: Wei Chen, Taoyuan Sien (TW); Jun Zhang, Taoyuan Sien (TW); Yue Quan Hu, Taoyuan Sien (TW)

(73) Assignee: Delta Electronics Inc., Taoyuan Sien (TW)

( * ) Notice: Subject to any disclaimer, the term of this patent is extended or adjusted under 35 U.S.C. 154(b) by 77 days.

(21) Appl. No.: 10/336,317

(22) Filed: Jan. 3, 2003

(65) Prior Publication Data

US 2003/0227365 A1 Dec. 11, 2003

(30) Foreign Application Priority Data

Jun. 11, 2002 (TW) ..... 91112703 A

(51) Int. Cl.
*H01F 27/24* (2006.01)

(52) U.S. Cl. ..... 336/212; 336/198; 336/83; 336/221

(58) Field of Classification Search ..... 336/182, 336/83, 160, 165, 178, 212, 221, 198, 208, 336/222

See application file for complete search history.

(56) References Cited

U.S. PATENT DOCUMENTS

| | | | | |
|---|---|---|---|---|
| 4,613,841 A * | 9/1986 | Roberts | ..... | 336/83 |
| 6,028,500 A * | 2/2000 | Buist | ..... | 336/100 |
| 6,356,182 B1 * | 3/2002 | Nagashima | ..... | 336/200 |
| 6,674,320 B2 * | 1/2004 | Duffy et al. | ..... | 327/555 |

* cited by examiner

*Primary Examiner*—Anh Mai
(74) *Attorney, Agent, or Firm*—Thomas, Kayden, Horstemeyer & Risle

(57) ABSTRACT

A transformer core that can realize a winding having a fractional number of turns. At least one of the two side posts of the transformer core has a trench or a through hole. The winding on the side post passes through the trench or the through hole. For a POT-type transformer core, the trench or the through hole is formed on the bobbin, and winding passes through the trench or the through hole on the bobbin.

19 Claims, 9 Drawing Sheets

TRANSFORMER CORE

BACKGROUND OF THE INVENTION

1. Field of the Invention

The invention relates to a transformer core and, in particular, to a transformer core that can realize a fractional number of turns, and a winding structure utilizing such a transformer core.

2. Description of the Related Art

FIG. 1 shows a conventional transformer core and winding structure, in which the number of turns can only be an integer. In FIG. 1, reference number 10 denotes an E-type core, and reference numbers 11 and 12 denote the primary winding and the secondary winding, respectively.

One problem with the conventional core is that sometimes the number of turns of the transformer is required to be a fractional number, which the conventional core cannot satisfy. For example, when the number of turns of the primary winding is 10 turns, and the transform ratio is required to be 0.33, the number of turns of the secondary winding must be 3.3 turns. Since the number of turns of the secondary winding of a conventional core can only be an integer, there is no choice but to re-design the transform ratio into 0.3 or 0.4, which results in an error of about 9.1% or 21.2%.

Another problem is that in some power switch circuits, the output voltage of the transformer needs to be finely tuned. Since the fractional number of turns cannot be realized in conventional core structures, the output voltage can only be tuned by additional voltage tuning circuits. This results in the increase of both the complexity and the power loss of the power switch circuits.

To overcome the above problems, one conventional solution is to vary the winding of the wires on the core structure. As shown in FIG. 2, the secondary winding 22 has an additional turn on the side post of the core 20. This additional turn on the side post can be treated as an additional 0.5 turn of the secondary winding 22. Using this method, a core structure can realize windings having a turn number of 0.5.

However, this solution still has a limitation in that the number of turns can only be a multiple of 0.5. The number of turns of a core structure still cannot be a fraction other than a multiple of 0.5.

SUMMARY OF THE INVENTION

In view of the above, an objective of the invention is to provide a transformer core that can realize a winding having a fractional number of turns.

Another objective of the invention is to provide a transformer winding structure in which the winding has a fractional number of turns.

In view of the above-mentioned objectives, the transformer core according to the invention includes a middle post and two side posts. At least one of the two side posts has a trench or a through hole.

The invention also provides a winding structure of a transformer. The core of the transformer has a middle post and two side posts, and at least one of the two side posts has a trench or a through hole. The windings on at least one of the two side posts pass through the trench or the through hole.

The invention further provides a winding structure of a transformer, in which the core of the transformer includes a bobbin and a middle post. The bobbin has a trench or a through hole, and the winding on the middle post passes through the trench or the through hole of the bobbin.

Since the side post or bobbin of the transformer core according to the invention has a trench or through hole, a fractional number of turns can be realized. The turn ratio can be adjusted by adjusting the position of the trench or the through hole.

These and other features, aspects, and advantages of the invention will become better understood with regard to the following description and accompanying drawing.

DETAILED DESCRIPTION OF THE INVENTION

The transformer core according to an embodiment of the invention will be described with reference to the accompanying drawings, wherein the same reference numbers denote the same elements.

Figure 1:
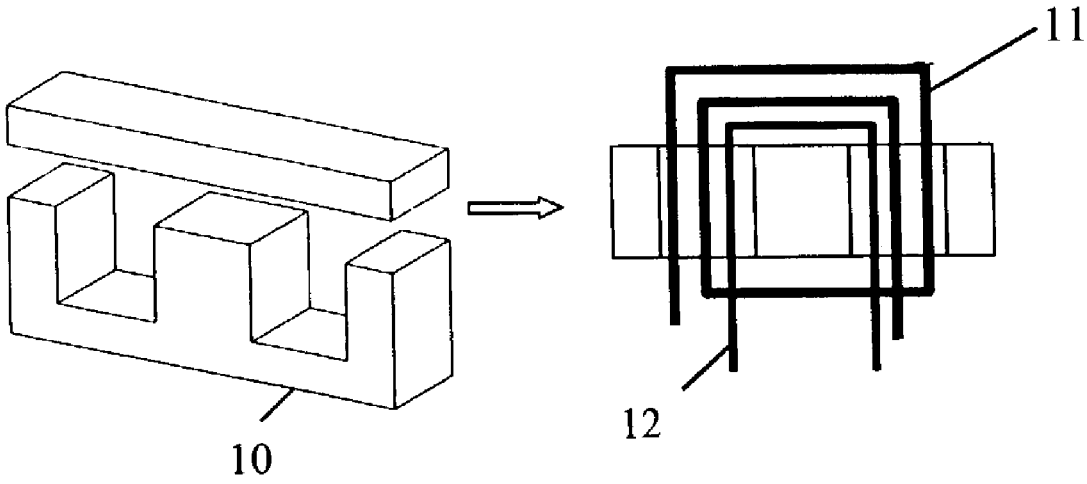
Fig. 1 (PRIOR ART)
FIG. 1 is a schematic diagram showing a transformer core in the prior art, in which the number of turns can only be an integer.
Figure 2:
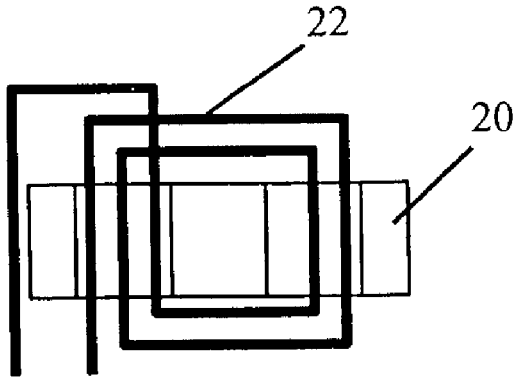
Fig. 2 (PRIOR ART)
FIG. 2 is a schematic diagram showing a transformer core in the prior art, in which windings having a turn number multiple of 0.5 can be realized.
Figure 3A:
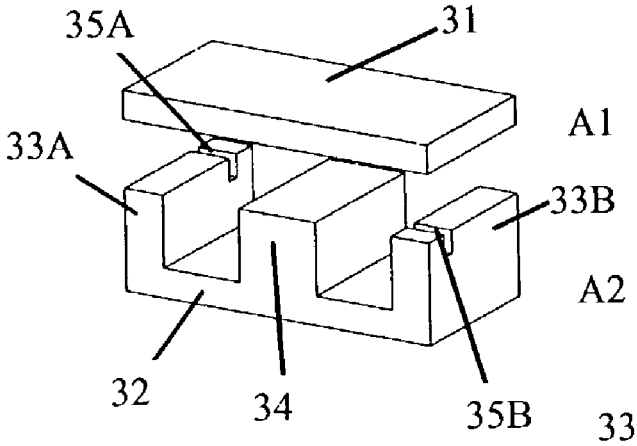
FIG. 3A is a schematic diagram showing an EI-type transformer core according to an embodiment of the invention.
Figure 3B:
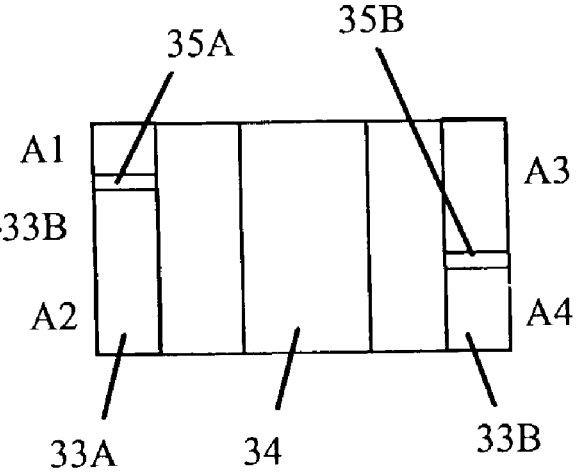
FIG. 3B is a top view of the transformer core shown in FIG. 3A.

FIGS. 3A and 3B show an EI-type transformer structure, which includes an E-type core 32 and an I-type core 31. The E-type core 32 includes a middle post 34 and two side posts 33A and 33B.

In a preferred embodiment, trenches 35A and 35B are formed on the side posts 33A and 33B, respectively. The trench 35A divides the cross-section of the side post 33A into two portions, A1 and A2 denoted in FIG. 3B. The trench 35B also divides the cross-section of the side post 33B into two portions, A3 and A4 denoted in FIG. 3B. In the present embodiment, the area ratio between A1 and A2 is 1:4, and the area ratio between A3 and A4 is 2:3. Different turn ratios of a transformer can be executed by adjusting the positions of the trenches 35A and 35B.

The principle of the transformer core according to the preferred embodiment of the invention will be described hereinbelow.

Figures 4A, 4B:
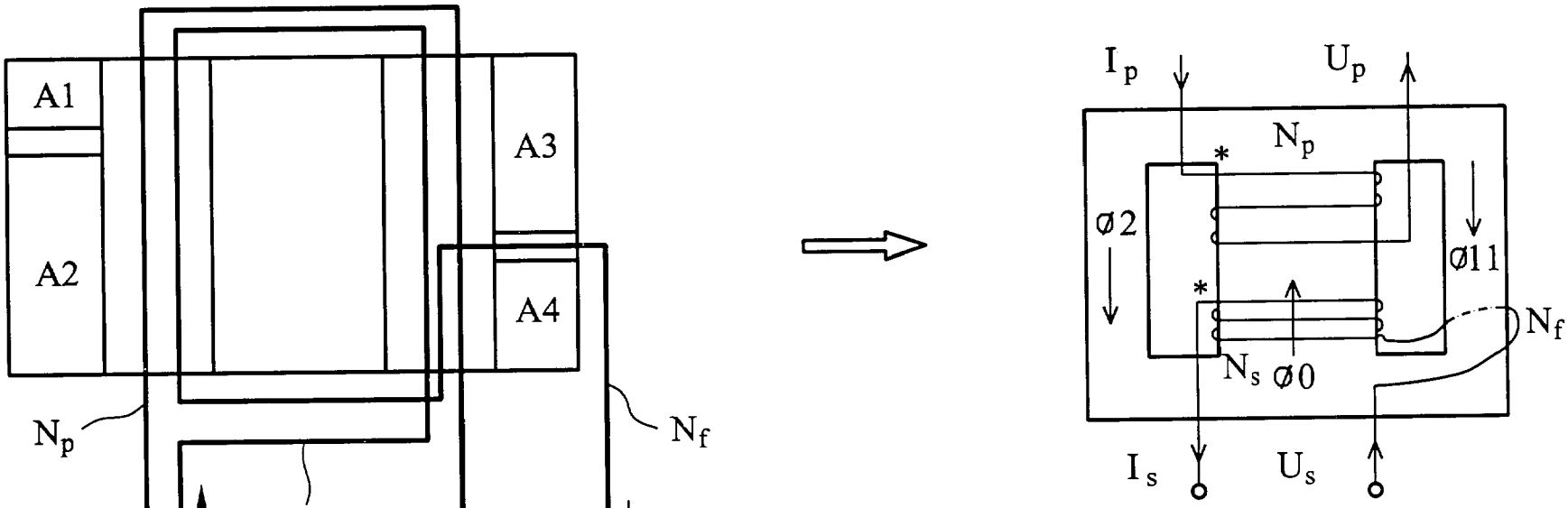
FIGS. 4A and 4B are schematic diagrams illustrating the principle of the transformer core of FIG. 3A realizing a fractional number of turns.
Figure 5A:
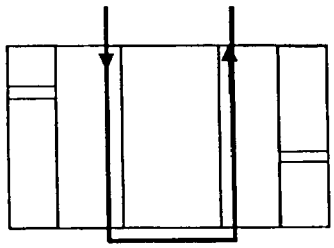
FIGS. 5A to 5J are schematic diagrams illustrating the transformer core of FIG. 3A with different windings having fractional numbers of turns from 1.0 to 1.9.
Figure 5B:
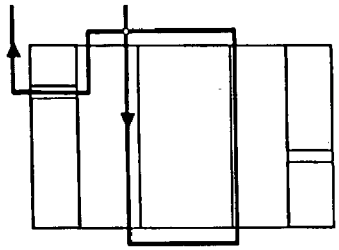
Figure 5C:
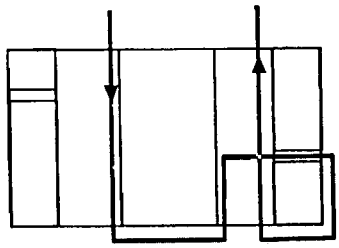
Figure 5D:
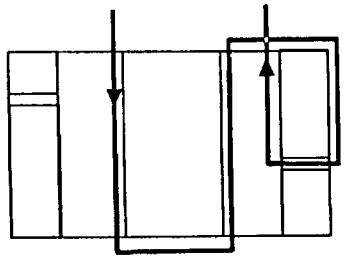
Figure 5E:
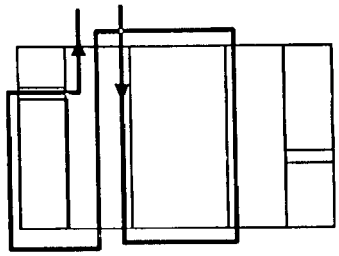
Figure 5F:
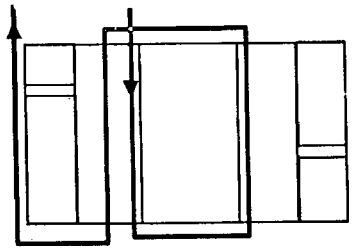
Figure 5G:
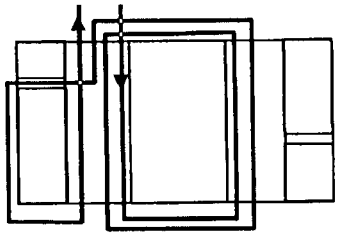
Figure 5H:
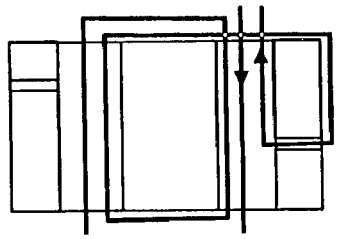
Figure 5I:
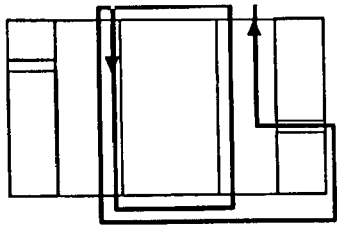
Figure 5J:
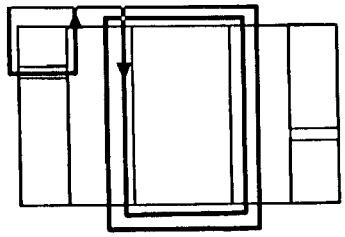

In FIGS. 4A and 4B, $N_p$ and $N_s$ are the numbers of turns of the primary side and the secondary side of the transformer, respectively. $N_f$ is the number of turns around the cross-section A4 of the side post 33B of the EI-type core. $u_p$ and $u_s$ are the voltages of the primary side and secondary side of the transformer, respectively, and $i_p$ and $i_s$ are currents of the primary side and secondary side of the transformer, respectively. $\Phi_0$ and $\Phi_2$ are the magnetic fluxes passing through the middle post 34 and the side post 33A, respectively, and $\Phi_{11}$ is the magnetic flux passing through the cross-section A4 of the side post 33B.

When the current $i_p$ is conducted on the primary side of the transformer, magnetic fluxes $\Phi_0$, $\Phi_2$ and $\Phi_{11}$ are generated having directions as shown in FIG. 4B. From the magnetic flux law:

$$\begin{cases} \Phi_0 = \dfrac{N_p i_p}{R_0 + R_1 \| R_2} \\ \Phi_2 = \dfrac{N_p i_p}{R_0 + R_1 \| R_2} \cdot \dfrac{R_1}{R_1 + R_2} \\ \Phi_{11} = \dfrac{N_p i_p}{R_0 + R_1 \| R_2} \cdot r \\ r = \dfrac{R_2 R_{12}}{R_{12} R_2 + R_{11} R_{12} + R_2 R_{11}} \end{cases}$$

wherein $R_0$, $R_1$ and $R_2$ are magnetic reluctance of the middle post 34 and two side posts 33A and 33B. $R_{11}$ and $R_{12}$ are magnetic reluctance of the cross-sections A4 and A3 of the side post 33B. The magnetic reluctance R1 is equal to the parallel connection of the reluctance $R_{11}$ and $R_{12}$, that is, $R_1 = R_{11} \| R_{12}$.

From the electromagnetic induction theory:

$$\begin{cases} u_p = N_p \dfrac{d\Phi_0}{dt} \\ u_s = N_s \dfrac{d\Phi_0}{dt} \pm N_f \dfrac{d\Phi_{11}}{dt} = (N_s \pm N_f \cdot r) \dfrac{d\Phi_0}{dt} \end{cases}$$

(The winding directions of the windings Ns and Nf determine polarity. The polarity is positive if the directions are the same, and negative if the directions are different.)

From the above, the transformer ratio of the transformer is $$\frac{u_s}{u_p} = \frac{N_s \pm N_f \cdot r}{N_p} = \frac{N_{se}}{N_p},$$

thus the effective turn ratio $N_{se}$ becomes a fraction. Since reluctance $$R = \frac{l}{\mu A},$$

if the length of the magnetic path l of the reluctance $R_1$ and $R_2$ are the same, then $$N_{se} = N_s \pm N_f \frac{A4}{A4 + A3 + A2 + A1} = N_s \pm N_f \frac{A4}{Ae}.$$

In this equation, Ae is the effective cross-section of the EI-type core, which is also the cross-section of the middle post of the core.

If A1=(1/10)*Ae, A2=(4/10)*Ae, A4=(2/10)*Ae, and A3=(3/10)*Ae, that is, A1:A2:A3:A4=1:4:3:2, then the fractional number of turns having a precision of 1/10 can be obtained by different winding types. FIGS. 5A to 5J illustrate different windings having fractional numbers of turns from 1.0 to 1.9.

Figure 6:
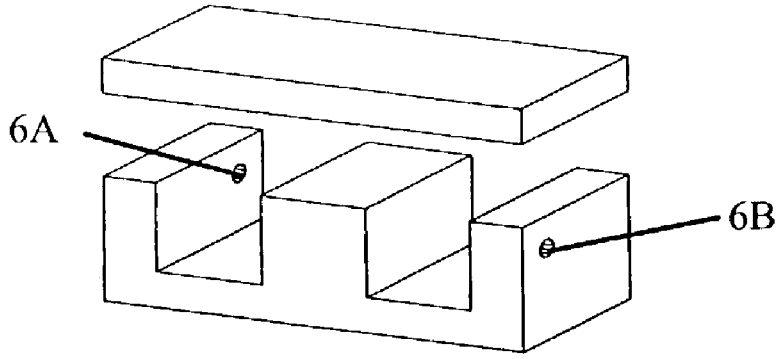
FIG. 6 is a schematic diagram showing a transformer core according to another embodiment of the invention.

In the present embodiment, different cross-section ratios are obtained by forming trenches on the side posts. In other embodiments, the trench may be substituted by through holes. FIG. 6 illustrates an embodiment in which through holes 6A and 6B are formed at the positions where the trenches are formed. The fractional number of turns can also be realized by passing the wires through the through holes 6A and 6B. The principle is the same as described above.

The width and depth of the trenches 35A and 35B and the shape of the through holes 6A and 6B can be determined according to the diameter of the wires.

In the above-described embodiments, a trench or a through hole is formed on each side post. In the embodiment described hereinafter, the trench is formed on one side post only.

Figure 7A:
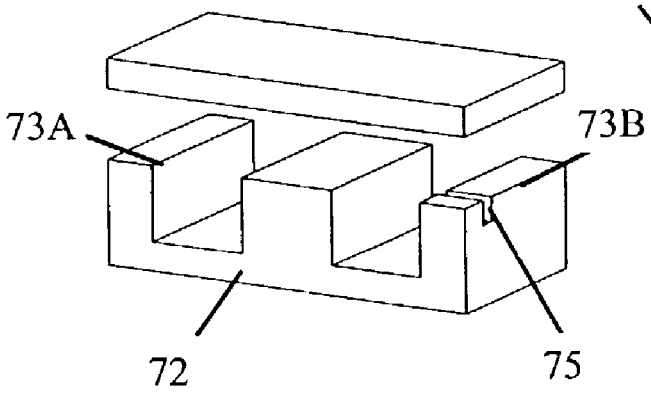
FIGS. 7A and 7B are schematic diagrams showing a transformer core according to still another embodiment of the invention.
Figure 7B:
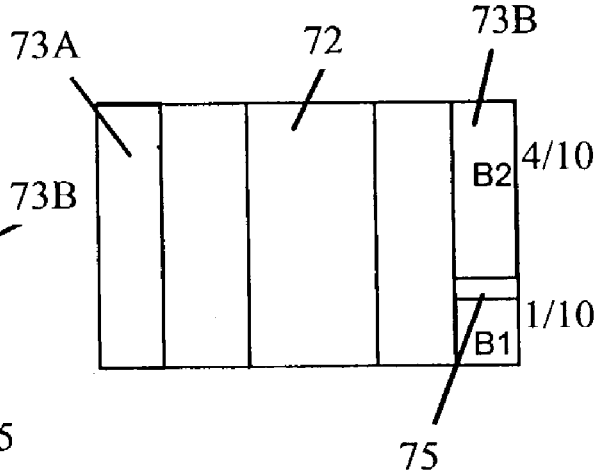
Figure 8A:
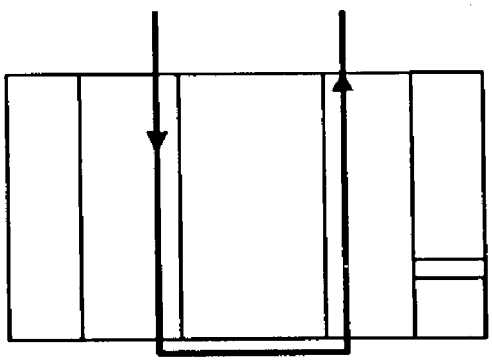
FIGS. 8A to 8J are schematic diagrams illustrating the transformer core of FIG. 7A with different windings having fractional numbers of turns from 1.0 to 1.9.
Figure 8B:
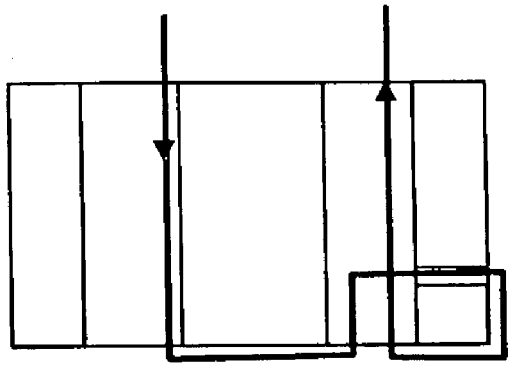
Figure 8C:
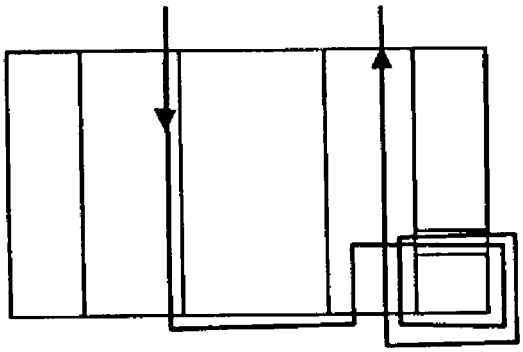
Figure 8D:
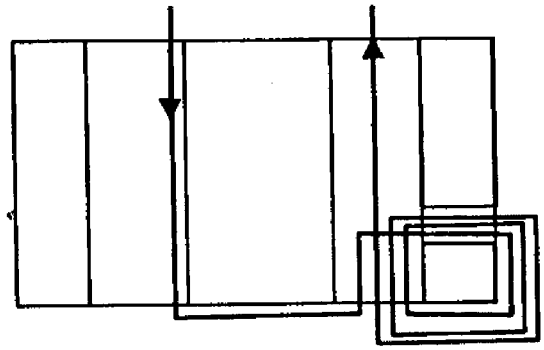
Figure 8E:
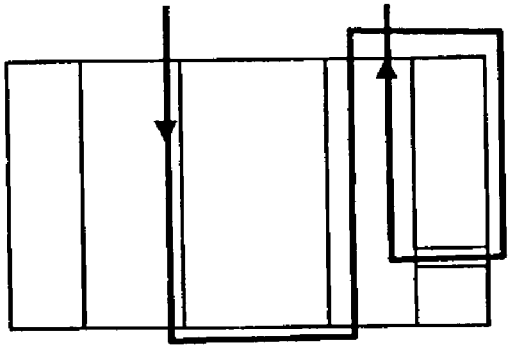
Figure 8F:
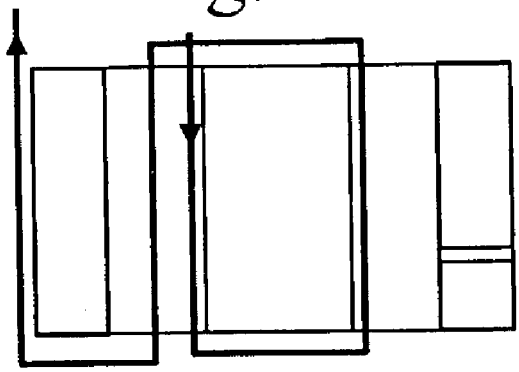
Figure 8G:
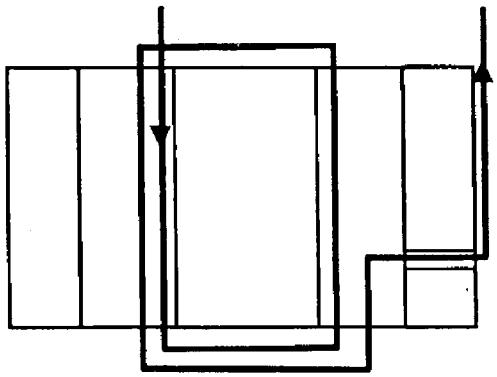
Figure 8H:
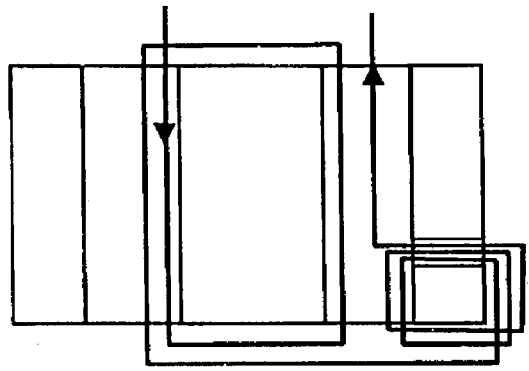
Figure 8I:
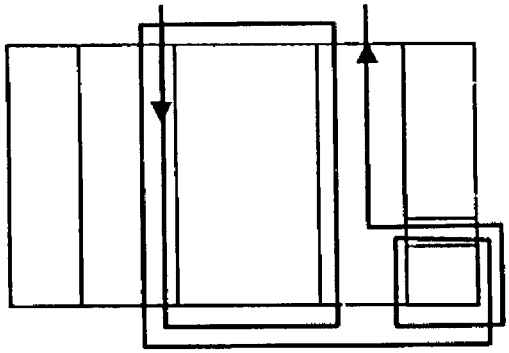
Figure 8J:
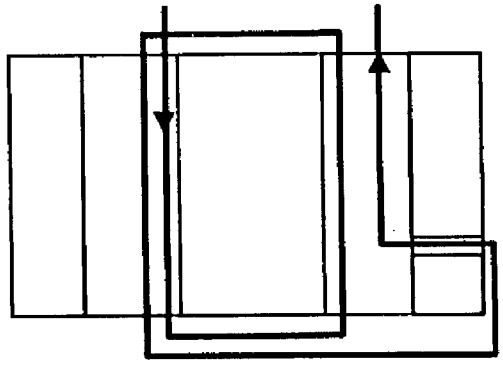

Referring to FIGS. 7A and 7B, a trench 75 is formed only on the side post 73B of an E-type core 72. No trench is formed on the side post 73A. The trench 75 divides the cross-section of the side post 73B into two portions B1 and B2, and the area ratio of the two portions B1 and B2 can be determined according to different turn ratio requirements.

In the present embodiment, the area ratio of the two portions B1 and B2 is 1:4. This core structure can realize different fractions of turn ratios. FIGS. 8A to 8J show different winding types realizing turn ratios from 1.0 to 1.9.

The embodiment of forming two trenches on each side post will be described hereinafter.

Figure 9A:
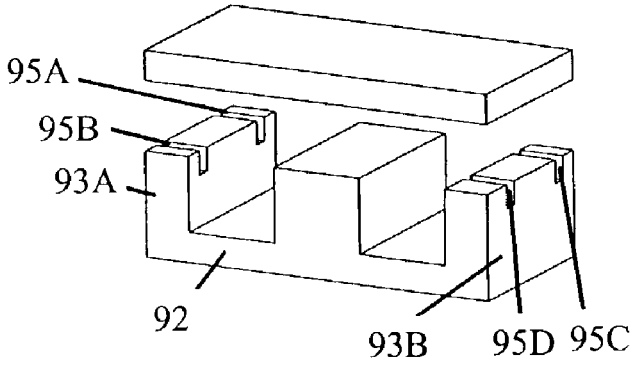
FIGS. 9A and 9B are schematic diagrams showing a transformer core according to still another embodiment of the invention.
Figure 9B:
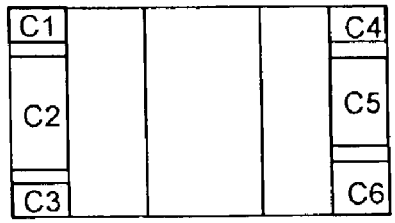

Referring to FIGS. 9A and 9B, two trenches 95A and 95B are formed on the side post 93A of an E-type core 92, dividing the cross-section of the side post 03A into three portions C1, C2, and C3. Two trenches 95C and 95D are also formed on the side post 93B, dividing the cross-section of the side post 93B into three portions C4, C5, and C6. The area ratio of the portions can be determined according to different turn ratio requirements. In the present embodiment, the area ratios are: C1:C2:C3= 1:4:1, and C4:C5:C6=1:3:2. The transformer structure of this kind can realize fractions of turn ratios up to a precision of 1/12. The minimum division can be determined according to requirement, and can be infinitely small, theoretically. Turn ratio methods providing multiples of 1/12 are similar to those described previously, and are thus not described herein.

In the embodiments shown in FIGS. 7A to 7B and 9A to 9B, the cross-sections of the side posts are divided by forming trenches. It should be noted that the trenches can be substituted by through holes under the same principle of the invention mentioned above.

Figure 10:
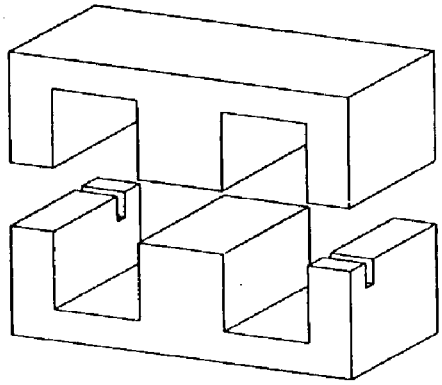
FIG. 10 is a schematic diagram showing an EE-type core having trenches.
Figure 11:
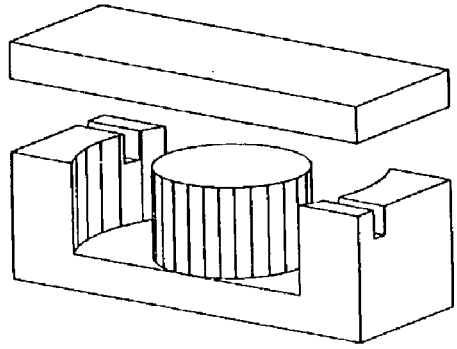
FIG. 11 is a schematic diagram showing an EC-type core having trenches.
Figure 12:
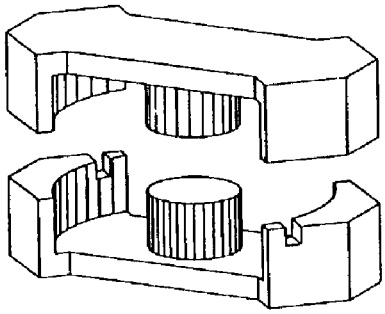
FIG. 12 is a schematic diagram showing a RM-type core having trenches.
Figure 13:
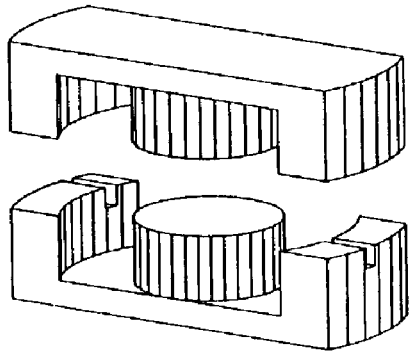
FIG. 13 is a schematic diagram showing a Q-type core having trenches.

In the embodiments described previously, the EI-type core is adopted for illustration purpose. However, it should be noted that the invention can also be implemented on other types of cores. For example, The EE-type core shown in FIG. 10, the EC-type core shown in FIG. 11, the RM type core shown in FIG. 12, and the Q-type core shown in FIG. 13 all include side posts. The methods of trench or through hole formation on the side posts are similar to those of the EI-type core, thus are not repeated herein.

Figure 14A:
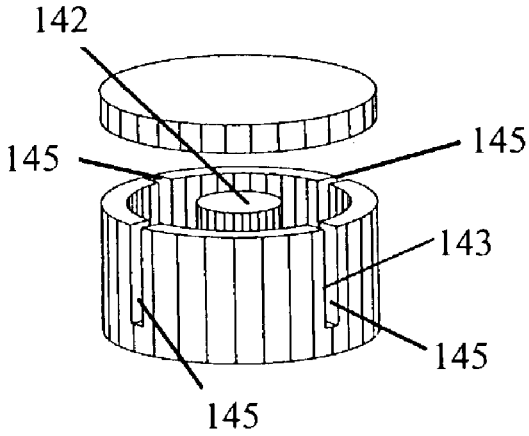
FIGS. 14A and 14B are schematic diagrams showing a POT-type core according to still another embodiment of the invention.
Figure 14B:
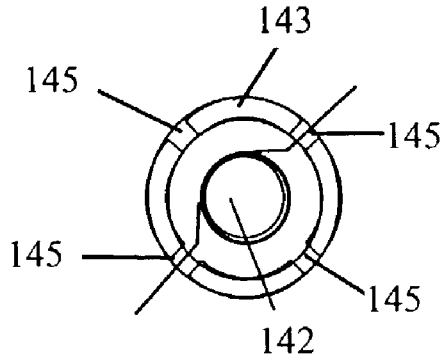

FIG. 14A shows a POT-type core according to another embodiment of the invention. Unlike an EI-type core, a POT-type core includes a middle post 142, and a bobbin 143 surrounding the middle post 142. In the present embodiment, four trenches 145 are formed on the bobbin 143, dividing the cross-section of the bobbin 143 into four portions equally. The transformer core structure of this kind can realize fractions of turn ratios being multiples of 1/4. The winding types realizing different turn ratios are shown in FIG. 14B.

Figure 15A:
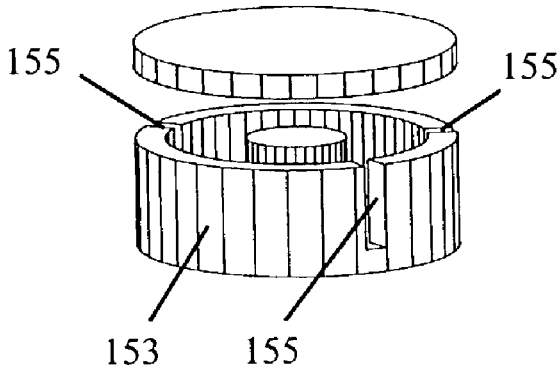
FIGS. 15A and 15B are schematic diagrams showing another POT-type core according to still another embodiment of the invention.
Figure 15B:
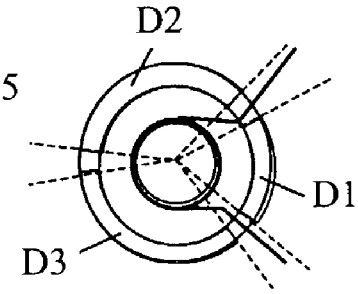

FIGS. 15A and 15B show an embodiment in which three trenches 155 are formed on the bobbin 153 of the POT-type core. The three trenches 155 divide the cross-section of the bobbin 153 into three portions D1, D2, and D3. The ratio of the three portions is: D1:D2:D3=1:2:2. This ratio allows the core to realize a fractional number of turns that is a multiple of 1/5 turns. The winding on the core is shown in FIG. 15B.

Figure 16:
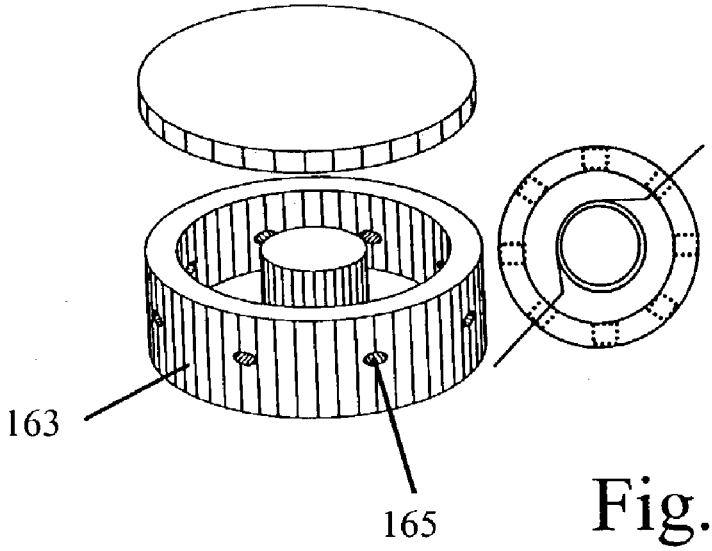
FIG. 16 is a schematic diagram showing still another POT-type core according to still another embodiment of the invention.

It should be noted that as for the embodiments shown in FIGS. 14A and 15A, the trenches can be substituted by through holes. FIG. 16 shows a POT-type core having through holes according to another embodiment of the invention. According to this embodiment, eight through holes 165 are formed on the bobbin 163. The eight through holes 165 divide the cross-section of the bobbin 163 into eight portions equally to realize a fractional number of turns that is a multiple of 1/8.

While the invention has been described with reference to preferred embodiments, this description is not intended to be construed in a limiting sense. Various modifications of the embodiment will be apparent to persons skilled in the art upon reference to the description. It is therefore intended that the appended claims encompass any such modifications.

What is claimed is:

1. A transformer assembly, comprising:

a transformer core comprising a middle post and two side posts, characterized in that at least one of the two side posts comprises at least one trench or through hole crossing therethrough; and a winding structure comprising windings, characterized in that the windings partially wound around at least one of the two side posts pass through the at least one trench or through hole.

2. The transformer assembly according to claim 1, wherein the at least one trench or through hole divides the cross-section of the at least one side post into two sub-cross-sections having an area ratio of 1:4.

3. The transformer assembly according to claim 1, wherein both side posts have the at least one trench or through hole.

4. The transformer assembly according to claim 3, wherein each side post has one trench or through hole.

5. The transformer assembly according to claim 4, wherein the cross-section of one of the two side posts is divided by the trench or through hole into two sub-cross-sections having an area ratio of 1:4, and the cross-section of the other side post is divided by the trench or through hole into two sub-cross-sections having an area ratio of 2:3.

6. The transformer assembly according to claim 3, wherein each side post has two trenches or through holes.

7. The transformer assembly according to claim 6, wherein the cross-section of one of the two side posts is divided into three sub-cross-sections having area ratios of 1:4:1, and the cross-section of the other side post is divided into three sub-cross-sections having area ratios of 1:3:2.

8. The transformer assembly according to claim 1, wherein the core is an EI-type core.

9. The transformer assembly according to claim 1, wherein the core is a Q-type core.

10. The transformer assembly according to claim 1, wherein the core is an EC-type core.

11. The transformer assembly according to claim 1, wherein the core is an EE-type core.

12. The transformer assembly according to claim 1, wherein the core is a RM-type core.

13. A transformer assembly, comprising:

a transformer core comprising a bobbin having a middle post, characterized in that the bobbin comprises at least three trenches or through holes crossing therethrough; and a winding structure comprising windings, characterized in that the windings partially wound around the middle post pass through the at least three trenches or through holes of the bobbin.

14. The transformer assembly according to claim 13, wherein the bobbin has four trenches or through holes dividing the cross-section of the bobbin into four sub-cross-sections having area ratios of 1:1:1:1.

15. The transformer assembly according to claim 13, wherein the bobbin has three trenches or through holes dividing the cross-section of the bobbin into three sub-cross-sections having area ratios of 1:2:2.

16. The transformer assembly according to claim 13, wherein the bobbin has eight trenches or through holes dividing the cross-section of the bobbin evenly.

17. The transformer assembly according to claim 13, wherein the bobbin has four trenches or through holes dividing the cross-section of the bobbin into four sub-cross-sections having area ratios of 1:1:1:1.

18. The transformer assembly according to claim 13, wherein the bobbin has three trenches or through holes dividing the cross-section of the bobbin into three sub-cross-sections having area ratios of 1:2:2.

19. The transformer assembly according to claim 13, wherein the bobbin has eight trenches or through holes dividing the cross-section of the bobbin evenly.

* * * * *